US008311841B2

(12) United States Patent
Miyasaka et al.

(10) Patent No.: US 8,311,841 B2
(45) **Date of Patent: *Nov. 13, 2012**

(54) ENCODING DEVICE, DECODING DEVICE, AND SYSTEM THEREOF UTILIZING BAND EXPANSION INFORMATION

(75) Inventors: Shuji Miyasaka, Neyagawa (JP); Tomokazu Ishikawa, Toyonaka (JP); Yoshiaki Sawada, Ibaraki (JP)

(73) Assignee: Panasonic Corporation, Osaka (JP)

( * ) Notice: Subject to any disclaimer, the term of this patent is extended or adjusted under 35 U.S.C. 154(b) by 353 days.

This patent is subject to a terminal disclaimer.

(21) Appl. No.: 11/806,971

(22) Filed: Jun. 5, 2007

(65) Prior Publication Data

US 2007/0239463 A1 Oct. 11, 2007

Related U.S. Application Data

(62) Division of application No. 10/288,364, filed on Nov. 6, 2002, now Pat. No. 7,260,540.

(30) Foreign Application Priority Data

Nov. 14, 2001 (JP) ..... 2001-348411

(51) Int. Cl.
*G10L 19/00* (2006.01)
*G10L 21/04* (2006.01)

(52) U.S. Cl. ..... 704/500; 704/503

(58) Field of Classification Search ..... 704/225, 704/200.1, 228, 500

See application file for complete search history.

(56) References Cited

U.S. PATENT DOCUMENTS 5,619,197 A 4/1997 Nakamura
5,734,657 A * 3/1998 Kim ..... 370/437
5,956,674 A * 9/1999 Smyth et al. ..... 704/200.1
(Continued)

FOREIGN PATENT DOCUMENTS

EP 880235 A1 * 11/1998
(Continued)

OTHER PUBLICATIONS

Farrugia, "Combined speech and audio coding with bit rate and bandwidth scalability", Sep. 3, 2001, In EUROSPEECH-2001, pp. 1-4.*

(Continued)

*Primary Examiner* — Richemond Dorvil
*Assistant Examiner* — Olujimi Adesanya
(74) *Attorney, Agent, or Firm* — Wenderoth, Lind & Ponack, L.L.P.

(57) ABSTRACT

A decoding device (30*a*) comprises a narrow-band decoding unit (31) operable to reproduce a PCM signal (P1) from a narrow-band bit stream included in a wide-band bit stream (S0), a wide-band decoding unit (32) operable to reproduce a PCM signal (P2) having a frequency band which is wider than that of the PCM signal (P1) reproduced by the narrow-band decoding unit (31) from the narrow-band bit stream and a band expanding bit stream included in the wide band bit stream (S0) and a selecting unit (34) operable to select either the PCM signal (P1) reproduced by the narrow-band decoding unit (31) or the PCM signal (P2) reproduced by the wide-band decoding unit (32), and to output the selected sound digital signal.

3 Claims, 16 Drawing Sheets

U.S. PATENT DOCUMENTS

| | | | | |
|---|---|---|---|---|
| 6,094,636 | A * | 7/2000 | Kim | 704/500 |
| 6,115,688 | A | 9/2000 | Brandenburg et al. | |
| 6,182,031 | B1 | 1/2001 | Kidder et al. | |
| 6,226,616 | B1 * | 5/2001 | You et al. | 704/500 |
| 6,240,388 | B1 * | 5/2001 | Fukuchi | 704/225 |
| 6,301,558 | B1 * | 10/2001 | Isozaki | 704/228 |
| 6,449,596 | B1 * | 9/2002 | Ejima | 704/501 |
| 6,704,711 | B2 * | 3/2004 | Gustafsson et al. | 704/258 |
| 6,707,398 | B1 * | 3/2004 | Lin et al. | 341/67 |
| 6,708,145 | B1 * | 3/2004 | Liljeryd et al. | 704/200.1 |
| 6,757,860 | B2 | 6/2004 | Choi et al. | |
| 6,895,375 | B2 * | 5/2005 | Malah et al. | 704/219 |
| 2001/0036321 | A1 | 11/2001 | Kishi | |
| 2003/0088327 | A1 * | 5/2003 | Taori et al. | 700/94 |
| 2003/0088423 | A1 | 5/2003 | Nishio et al. | |

FOREIGN PATENT DOCUMENTS

| | | |
|---|---|---|
| EP | 0 884 850 | 12/1998 |
| EP | 1 374 230 | 6/2006 |
| JP | 2000-244384 | 9/2000 |
| WO | 99/50828 | 10/1999 |

OTHER PUBLICATIONS

M. Bosi, et al., ISO/IEC JTC1/SC29/WG11 N1650, entitled "*Coding of Moving Pictures and Audio*", IS 13817-7 (MPEG-2 Advanced Audio Coding, AAC), Apr. 1997.

U.S. Appl. No. 10/285,633, filed Nov. 1, 2002, entitled "*Encoding Device and Decoding Device*".

U.S. Appl. No. 10/285,609, filed Nov. 1, 2002, entitled "*Encoding Device and Decoding Device*".

U.S. Appl. No. 10/285,627, filed Nov. 1, 2002, entitled "*Encoding Device, Decoding Device and Audio Data Distribution System*".

U.S. Appl. No. 10/140,881, filed May 9, 2002, entitled "*Encoding Device, Decoding Device, and Broadcast System*".

Quackenbush, S.R., entitled "*Coding of Natural Audio in MPEG-4*", Acoustics, Speech and Signal Processing, 1998, Proceedings of the 1998 IEEE International Conference in Seattle, WA, USA May 12-15, 1998, New York, NY, USA, IEEE, US, May 12, 1998, pp. 3797-3800.

ETSI TS 101 980 V1.1.1 (Sep. 2001), Technical Specification, Digital radio Mondiale (DRM); System Specification.

* cited by examiner

ENCODING DEVICE, DECODING DEVICE, AND SYSTEM THEREOF UTILIZING BAND EXPANSION INFORMATION

This application is a divisional of application Ser. No. 10/288,364, filed Nov. 6, 2002 now U.S. Pat. No. 7,260,540.

TECHNICAL FIELD

The present invention relates to encoding and decoding processing of audio signals, and more specially to an encoding device and a decoding device for creating a format of encoded data that facilitates decoding processing, and to a system utilizing such devices.

BACKGROUND ART

In response to popular demand for easy-to-enjoy music, a variety of technologies have been developed in recent years for performing compression encoding for audio signals such as voice and musical sounds at low bit rates and performing decompression decoding when reproducing these signals. A representative example of such technologies is the MPEG MC system (to be abbreviated as "AAC" hereinafter) (Refer to: M. Bosi, et al.: "IS 13818-7 (MPEG-2 Advanced Audio Coding, MC)," April, 1997)

FIG. 1 is a diagram showing a frequency band to be encoded in the MC system.

However, since an increased compression rate results in a lower upper limit frequency of the reproduction band, no high frequencies can be reproduced. For, as a compression rate increases, a sufficient number of bits for encoding the high frequency band cannot be allocated, making the upper limit of the reproduction band lower.

Against this backdrop, recent years have witnessed technological development of as well as standardization for pseudo wide band as part of the standardization effort of MPEG4 Ver. 3, with the view to cover such lack of signals at high frequencies.

As shown in FIG. 2, the above-mentioned technology is intended, for example, to cover the lack of signals at high frequencies using band information of the narrow band, that is, information at low frequencies to predict high frequency information. The use of such technology with which pseudo wide band is created makes it possible to listen to high-quality music and watch news on such a battery-operated device as a mobile phone.

However, the constant provision of high-quality sounds ends up meaningless in many cases. To put it another way, when listening to news, for example, there are fewer user requests for reproducing sounds for which pseudo wide band is created, meaning that it is impractical for a decoding device to perform pseudo wide band processing. Furthermore, it results in a waste of battery power of a mobile phone and other devices embedded with a decoding device, which performs pseudo wide band processing even when there is no user request for this processing.

The present invention is intended to solve such problems whose first object is to provide a decoding device capable of eliminating the redundancy of listening to high-quality sounds all the time even when it is not desired.

The second object of the present invention is to provide a decoding device that allows the use of a smaller amount of battery energy when a digital signal (to be referred to also as a "PCM signal" hereinafter) of sounds in the narrow band is reproduced.

The third object of the present invention is to provide an encoding device and a system facilitating the achievement of the above first and the second objects.

SUMMARY OF THE INVENTION

In order to achieve the first object above, the decoding device according to the present invention is a decoding device that decodes an encoded signal made up of a first bit stream which is an encoded sound digital signal and of a second bit stream which is an encoded band expansion information used for expanding a reproduction band of the sound digital signal, the decoding device comprising: a first reproducing unit operable to reproduce a first sound digital signal from the first bit stream; a second reproducing unit operable to reproduce a second sound digital signal having a frequency band which is wider than that of the first sound digital signal reproduced by the first reproducing unit from the first bit stream and the second bit stream; and a selecting unit operable to select either the first sound digital signal reproduced by the first reproducing unit or the second sound digital signal reproduced by the second reproducing unit, and to output the selected sound digital signal.

Accordingly, the selecting unit makes it extremely easy to make a selection between the second sound digital signal in the wide band to be outputted from the second reproducing unit and the first sound digital signal in the narrow band to be outputted from the first reproducing unit and to reproduce either of them.

In this case, the decoding device can be configured to further comprise a mode setting unit operable to notify the selecting unit of mode information specifying either a first mode or a second mode, wherein the selecting unit selects and outputs the first sound digital signal reproduced by the first reproducing unit when the mode information notified by the mode setting unit indicates the first mode, and selects and outputs the second sound digital signal reproduced by the second reproducing unit when the mode information notified by the mode setting unit indicates the second mode.

Accordingly, it becomes possible to make a selection between the first sound digital signal in the narrow band and the second sound digital signal in the wide band, according to a mode determined (specified) by a user, a mode to be determined depending on a signal type, and a mode to be determined depending on the state of a device.

Moreover, the first reproducing unit can be configured to have: a first separating unit operable to separate the first bit stream from the encoded signal; a first converting unit operable to convert the first bit stream separated by the first separating unit to an intermediate signal; and a second converting unit operable to convert the intermediate signal acquired as a result of the conversion in the first converting unit to the first sound digital signal, and the second reproducing unit has a second separating unit operable to separate the second bit stream from the encoded signal, and reproduces the second sound digital signal using band expansion information included in the second bit stream which is separated by the second separating unit and using the intermediate signal acquired as a result of the conversion in the first converting unit, the intermediate signal can be configured to serve as information indicating a frequency spectrum, the second reproducing unit can be configured to further have: a wide-band spectrum generating unit operable to generate a wider frequency spectrum than the frequency spectrum from the frequency spectrum information acquired by the first converting unit according to the band expansion information; and a wide-band sound digital signal generating unit operable to generate a sound digital signal in the wide band from the generated frequency spectrum and from the frequency spectrum acquired by the first converting unit, and the decoding device can be configured to further comprise a mode setting unit operable to notify the selecting unit of mode information specifying either the first mode or the second mode, wherein the selecting unit selects and outputs the sound digital signal reproduced by the first reproducing unit when the mode information notified by the mode setting unit indicates the first mode, and selects and outputs the sound digital signal reproduced by the second reproducing unit when the mode information notified by the mode setting unit indicates the second mode.

Accordingly, an efficient reproduction of the wide band by the use of an intermediate signal as well as a selection according to mode information becomes possible.

Furthermore, in order to achieve the second object, a decoding device according to the present invention is the decoding device, wherein the mode setting unit further notifies the second reproducing unit of the mode information, and the second reproducing unit stops reproduction from the second bit stream to the second sound digital signal when the mode information notified by the mode setting unit indicates the first mode, and the mode setting unit further notifies the second reproducing unit of the mode information, and the second reproducing unit has at least either the wide-band spectrum generating unit stop generation of the frequency spectrum or the wide-band sound digital signal generating unit stop generation of the second sound digital signal.

Accordingly, unnecessarily performed processing can be stopped in an efficient manner when the second sound digital signal is not reproduced, which leads to reduction in the processing amount and further to reduction in power consumption.

Moreover, the first bit stream and the second bit stream can be configured to be alternately multiplexed per specific frame, and the second reproducing unit to have the second separating unit operable to separate the second bit stream from the encoded signal, a code amount of the band expansion information can be configured to be variable per frame, and size information indicating a size of the codes to be multiplexed into the second bit stream, and the second separating unit to separate the second bit stream from the encoded signal according to the size information included in the second bit stream, the size information can be configured to be placed at a top of the second bit stream, and the second separating unit to specify a size of the codes for the band expansion information according to the size information included at the top of the second bit stream, and to separate the second bit stream from the encoded signal based on the specified size, the size information can be configured to be N bits or (N+M) bits indicating the size of the codes for the band expansion information, and the second separating unit to specify the size of the codes for the band expansion information according to the N or (N+M) bits included at the top of the second bit stream, and to separate the second bit stream from the encoded signal according to the specified size, and N bits in the (N+M) bits can be configured to indicate a maximum value which N bits can represent, and the M bits to indicate a size of codes exceeding a size indicated by the maximum value, out of the code amount of the band expansion information.

Accordingly, while an efficient reproduction of the wide band and the narrow band based on the size information of a small amount of bit number becomes possible, reproduction with the reading of information for band expansion and processing for wide-band decoding being skipped also becomes possible just by referring to the size information when a high frequency signal is not reproduced, which results in a significant reduction in processing amount as well as in power consumption.

Furthermore, an encoding device according to the present invention is the encoding device that encodes a sound digital signal and comprises: a first encoding unit operable to encode an inputted sound digital signal; a second encoding unit operable to generate to encode band expansion information used for expanding a reproduction band of the signal encoded by the first encoding unit from the inputted sound digital signal; a size calculating unit operable to calculate a size of the encoded signal acquired by the second encoding unit; a first multiplexing unit operable to multiplex information indicating the size calculated by the size calculating unit and the encoded signal acquired by the second encoding unit; and a second multiplexing unit operable to multiplex a first bit stream acquired by the first encoding unit and a second bit stream acquired by the first multiplexing unit.

Accordingly, not only is it possible to make an extremely easy selection between a wide-band sound digital signal and a narrow-band sound digital signal in the decoding device, unnecessarily performed processing at the time of reproducing a PCM signal in the narrow band can also be skipped with extreme easiness.

Here, the second multiplexing unit can be configured to alternately multiplex the first bit stream and the second bit stream per specific frame, the first multiplexing unit can be configured to multiplex the information indicating the size and the encoded signal in a manner in which the information indicating the size is placed at the top of the second bit stream, and the information indicating the size can be configured to be N bits or (N+M) bits indicating a size of codes for the band expansion information, and the size calculating unit to determine whether to use N bits or (N+M) bits according to whether or not the size of the codes for the band expansion information is smaller than a maximum value represented by N bits, and N bits in the (N+M) bits to indicate the maximum value which N bits can represent, and the M bits to indicate a size of codes exceeding a size indicated by the maximum value, out of the code amount of the band expansion information.

Accordingly, while an efficient reproduction of the wide band and the narrow band based on the size information of a small number of bits can be realized in the decoding device, it also becomes possible to carry out reproduction with the reading of information for band expansion and processing for decoding the wide band being skipped just by refereeing to the size information when a high frequency signal is not reproduced, which contributes to a significant reduction in the processing amount as well as in power consumption.

Since the above effects are best demonstrated especially in such a battery-operated device as a mobile phone, the present invention is extremely feasible. Furthermore, in a device to decode encoded data for which such band expansion technology is applied, selection of whether to reproduce the second sound digital signal for which band expansion is performed or the first sound digital signal for which band expansion is not performed should be able to be made, considering power consumption of a device, listener's likings and so forth. Such function perfectly satisfies the inventors of the present invention who wish to make it possible to reproduce the first sound digital signal for which band expansion is not performed when receiving, for example, a voice broadcast such as news, in order to reduce power consumption.

Meanwhile, it goes without saying that the present invention can be realized as a communication system made up of an encoding device and a decoding device, as an encoding method/decoding method/communication method which has characteristic units making up the above encoding device, decoding device and communication system as its steps, as an encoding program/decoding program which has a CPU execute characteristic units and steps making up the above encoding device and decoding device, and as a computer-readable storage medium where a decoded signal is stored in which the first bit stream, that is, an encoded first sound digital signal and the second bit stream, that is, an encoded band expansion information used for expanding the reproduction band of the second sound digital signal are multiplexed per frame.

BRIEF DESCRIPTION OF DRAWINGS

These and other objects, advantages and features of the invention will become apparent from the following description thereof taken in conjunction with the accompanying drawings that illustrate a specific embodiment of the invention. In the Drawings.

DETAILED DESCRIPTION OF THE INVENTION

Explanations of an encoding device, a decoding device and a system utilizing these devices according to the present invention are provided with reference to the figures.

The First Embodiment

First, an explanation is provided for a decoding device which facilitates the achievement of the first and the second objects in an encoding device.

An encoding device according to the First Embodiment of the present invention is explained in subsequent paragraphs with reference to the figures.

Figure 3:
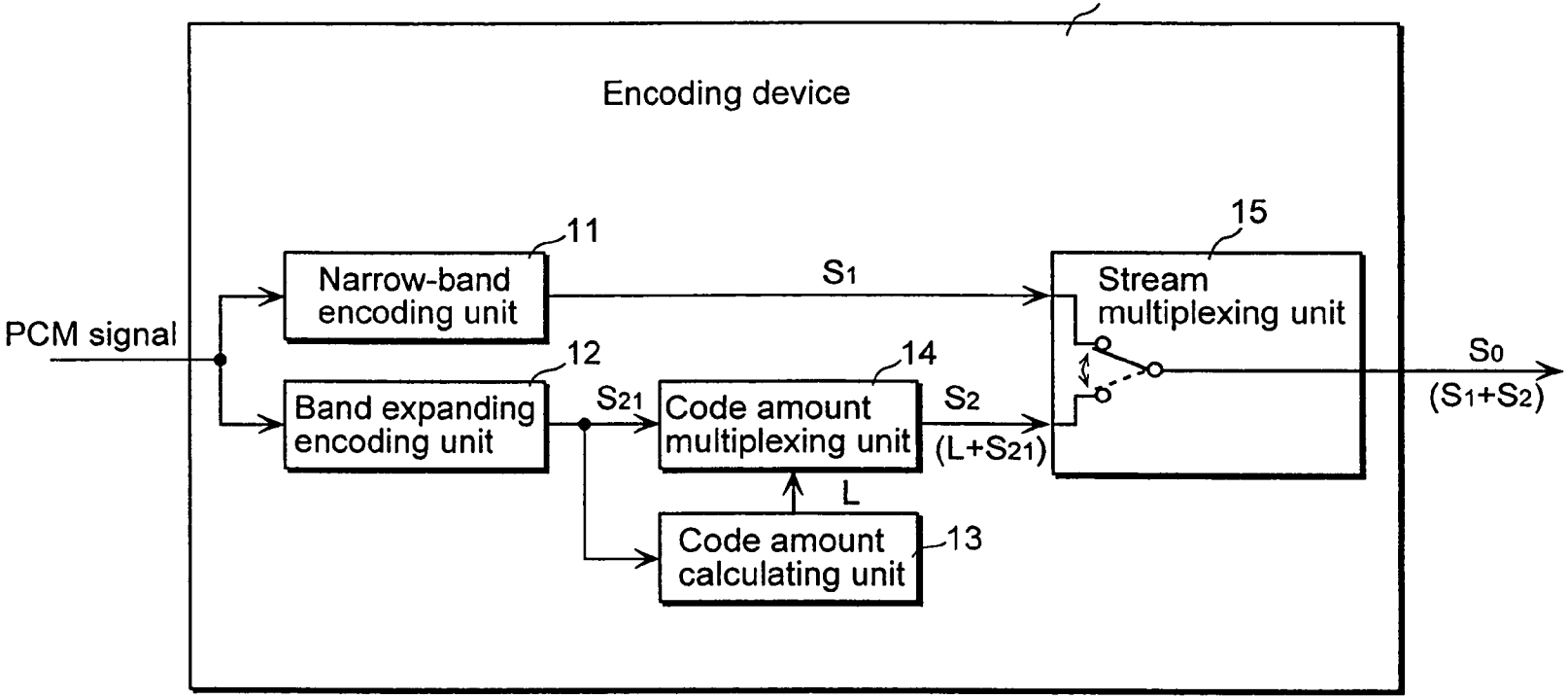
FIG. 3 is a block diagram showing a functional configuration of an encoding device according to the First Embodiment.

FIG. 3 is a block diagram illustrating a functional configuration of an encoding device 10 according to the First Embodiment.

The encoding device 10 is comprised of a narrow-band encoding unit 11, a band expanding encoding unit 12, a code amount calculating unit 13, a code amount multiplexing unit 14, and a stream multiplexing unit 15.

The narrow-band encoding unit 11 encodes an inputted PCM signal per frame (in MC, 1024 samples in the audio data row) and generates a narrow-band bit stream S1 at low frequencies.

Based on the inputted PCM signal, the band expanding encoding unit 12 acquires band expansion information used for expanding the reproduction band of a reproduced signal, encodes the acquired expansion information per frame and generates a band expansion information bit stream S21 at high frequencies.

The code amount calculating unit 13 calculates the code amount (size) L of the band expansion information bit stream S21 outputted from the band expanding encoding unit 12 per frame.

The code amount multiplexing unit 14 multiplexes a signal to be determined according to the code amount L and an output signal from the band expanding encoding unit 12 to generate a band expansion bit stream S2 (=L+S21) at high frequencies.

The stream multiplexing unit 15 multiplexes the narrow-band bit stream S1 outputted from the narrow-band encoding unit 11 and the band expansion bit stream S2 outputted from the code amount multiplexing unit 14 per frame to generate a wide-band bit stream S0.

Note that each unit making up such an encoding device as the encoding device 10 is realized by a CPU, ROM to store a program executed by the CPU, a memory which provides a work area when the program is executed and which temporarily memorizes data including sound data of an inputted PCM signal and others.

Figure 4:
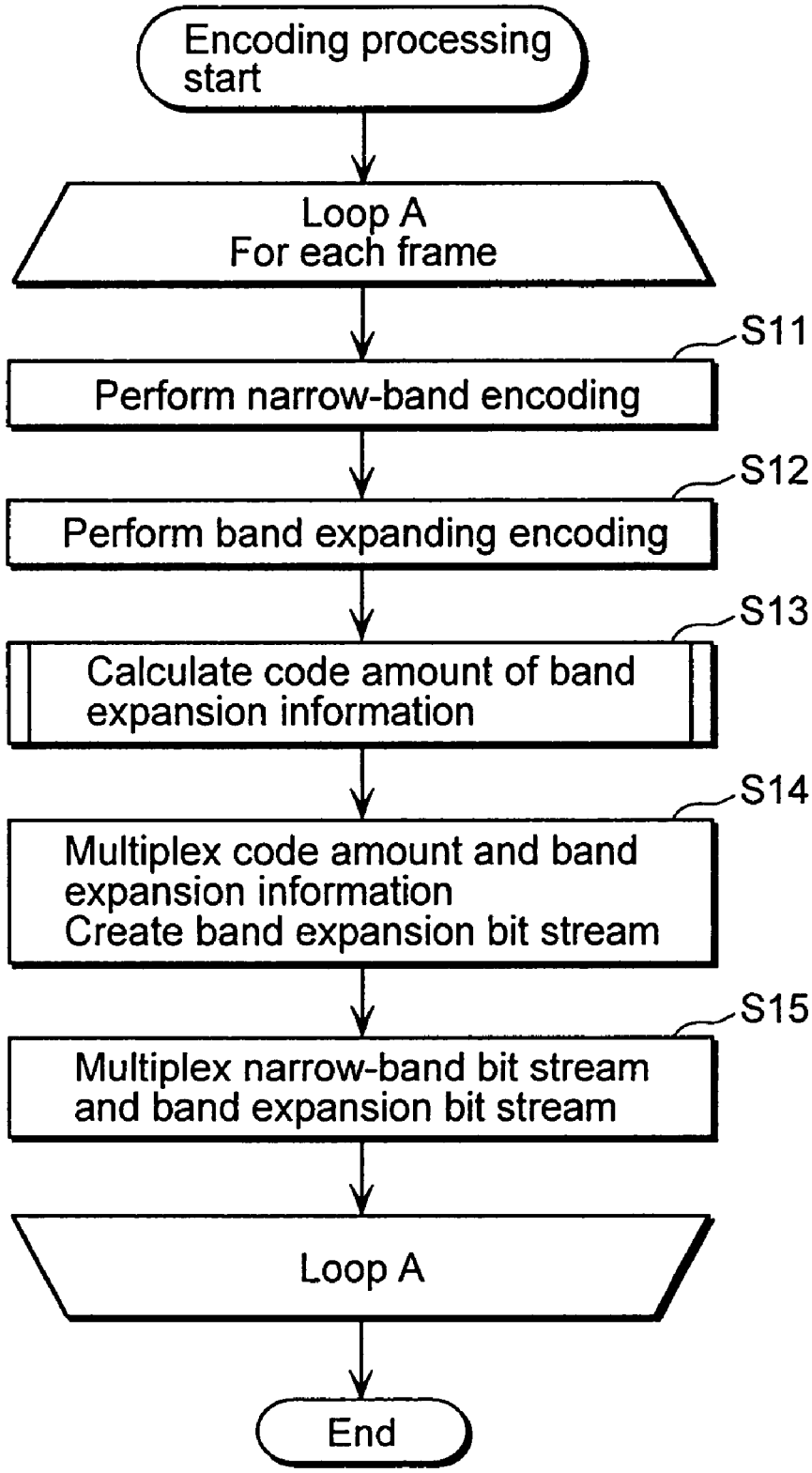
FIG. 4 is a flowchart showing a flow of processing performed by each unit in an encoding device 10 shown in FIG. 3.

An explanation is given for the operation of the encoding device 10 having the above-mentioned configuration with reference to the flowchart illustrated in FIG. 4.

First, the narrow-band encoding unit 11 encodes an inputted PCM signal per frame to generate the narrow-band bit stream S1 (S11).

Figure 1:
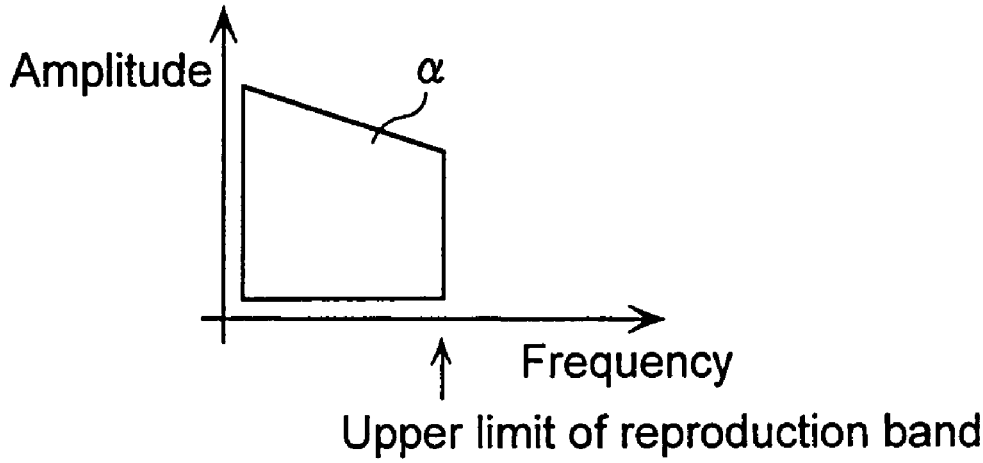
FIG. 1 is a diagram showing a frequency band to be encoded according to the AAC standard.

The narrow-band bit stream S1 here is something like a bit stream in the MPEG MC system. In other words, the frequency band of a signal to be encoded here can be represented, for example, by the part enclosed in the solid lines α in FIG. 1 (ISO/IEC 13818-7: 1997).

Figure 2:
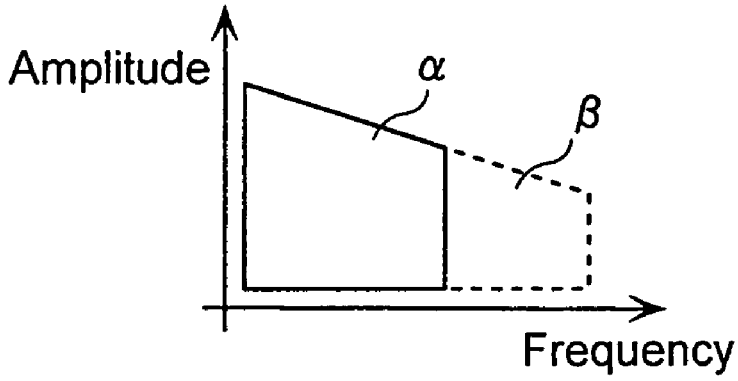
FIG. 2 is a diagram showing a frequency band to be expanded through band expanding processing.

Next, the band expanding encoding unit 12 encodes band expansion information used for expanding the reproduction band of a reproduced signal per frame (S12). Since signals in the higher frequency band are lacking just by reproducing the frequencies in the part represented by the part enclosed in the solid lines α in FIG. 1, the extraction and encoding of information which covers this deficiency is required. For example, information in the higher frequency band is predicted according to the signals in the frequency band enclosed in the solid lines in FIG. 1 to encode the information for covering the deficiency. Such information is represented by the part enclosed in the dotted lines β in FIG. 2.

Next, the code amount calculating unit 13 calculates by the byte the per-frame code amount (size) L outputted from the band expanding encoding unit 12 (S13).

Figure 5:
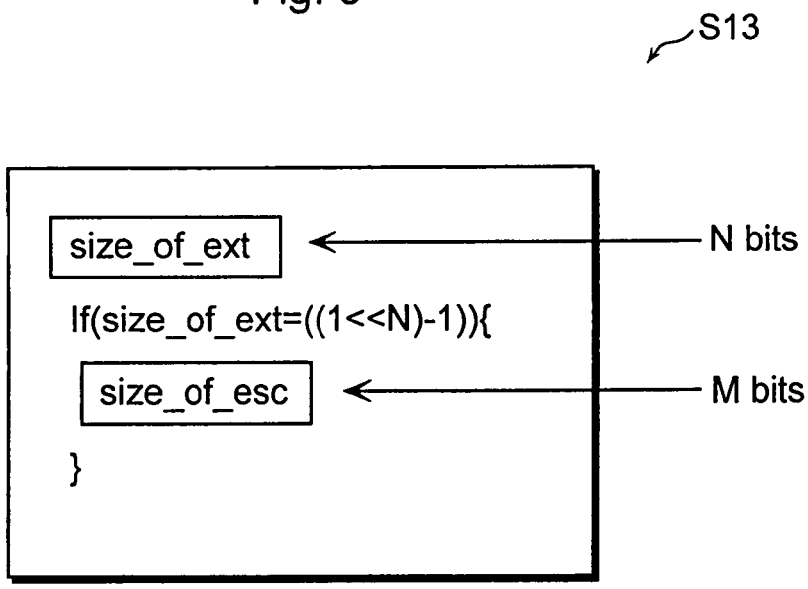
FIG. 5 is a diagram showing details of processing performed when the code amount calculated in Step S13 in FIG. 4 is multiplexed into a band expansion bit stream S2.
Figure 6A:
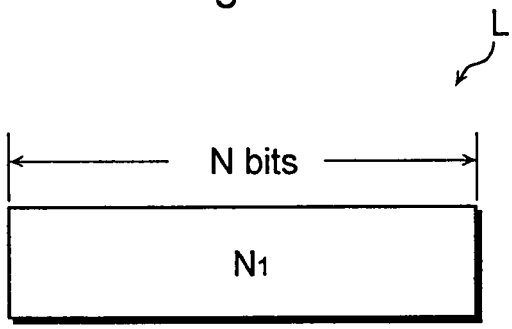
FIG. 6A is a diagram showing a configuration example of a length information L of a bit stream generated through processing shown in FIG. 5. To be more specific, this diagram shows the case where the length information L is configured only with an N bit field (size_of_ext).
Figure 6B:
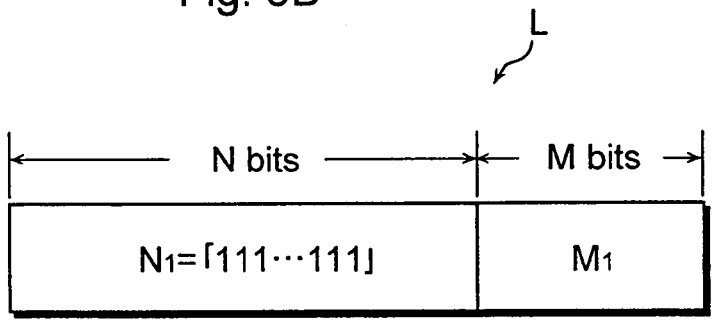
FIG. 6B is a diagram showing a configuration example of a length information L of a bit stream generated through processing shown in FIG. 5. To be more specific, this diagram shows the case where the length information L is configured with the N bit field (size_of_ext) and an additional M bit field (size_of_esc).

FIG. 5 is a diagram showing details of processing performed when the code amount calculated in Step S13 in FIG. 4 is multiplexed into the band expansion bit stream S2, while FIG. 6A and FIG. 6B are diagrams providing configuration examples of the length information L to be generated in the processing shown in FIG. 5. Note that FIG. 6A illustrates the case where the length information L is configured only with an N bit field (size_of_ext), while FIG. 6B illustrates the case where the length information L is configured with the above N bit field (size_of_ext) and an additional M bit field (size_of_esc).

The reason why two cases are provided as above is that, since the code amount of band expansion information is variable on a per-frame basis, there may arise the case where the length information (code amount) L cannot be represented only by an N bit field (size_of_ext), which then necessitates an additional M bit field (size_of_esc).

For example, when N is 4 bits, 14 (0x1110) is represented using this 4 bit field if the code amount L is 14 bytes or smaller. In this case, since the N bit field (size_of_ext) is not ((1<<N)−1), that is, "0x1111", there is no additional bit field (size_of_esc). On the other hand, when the code amount L is 15 bytes or bigger, that the code amount L is 15 bytes or bigger is represented by representing the maximum value 15 (0x1111) using a 4 bit field, and then the part over 15 is represented using an additional M bit field (size_of_esc). For example, if the code amount L is 20 bytes, an N bit field (size_of_ext) is "0x1111" and an additional M bit field (size_of_esc) is "0x00000101" when M is 8 bits.

When the N and M are both 8 bits, and the value of size information is 128 bytes, the N bit field (size_of_ext) is b '10000000, while there exists no additional bit field (size_of_esc), since size_of_ext is not ((1<<N)−1), that is, b '11111111. Next, when the value of size information is 257 bytes, for example, an N bit field (size_of_ext) is b '11111111 and the value of size_of_esc is b '00000010.

With the above approach, when the value of size information is smaller than 255 bytes, it is represented only by 8 bits, and when the value is 255 bytes or bigger, (255+γ) is further represented by 8 bits.

Next, the code amount multiplexing unit 14 multiplexes a signal to be determined according to the code amount L and an output signal from the band expanding encoding unit 12 to generate the band expansion bit stream S2 (S14).

Finally, the stream multiplexing unit 15 multiplexes the narrow-band bit stream outputted from the first encoding unit and the band expansion bit stream outputted from the first multiplexing unit per frame (S15).

Figure 7:
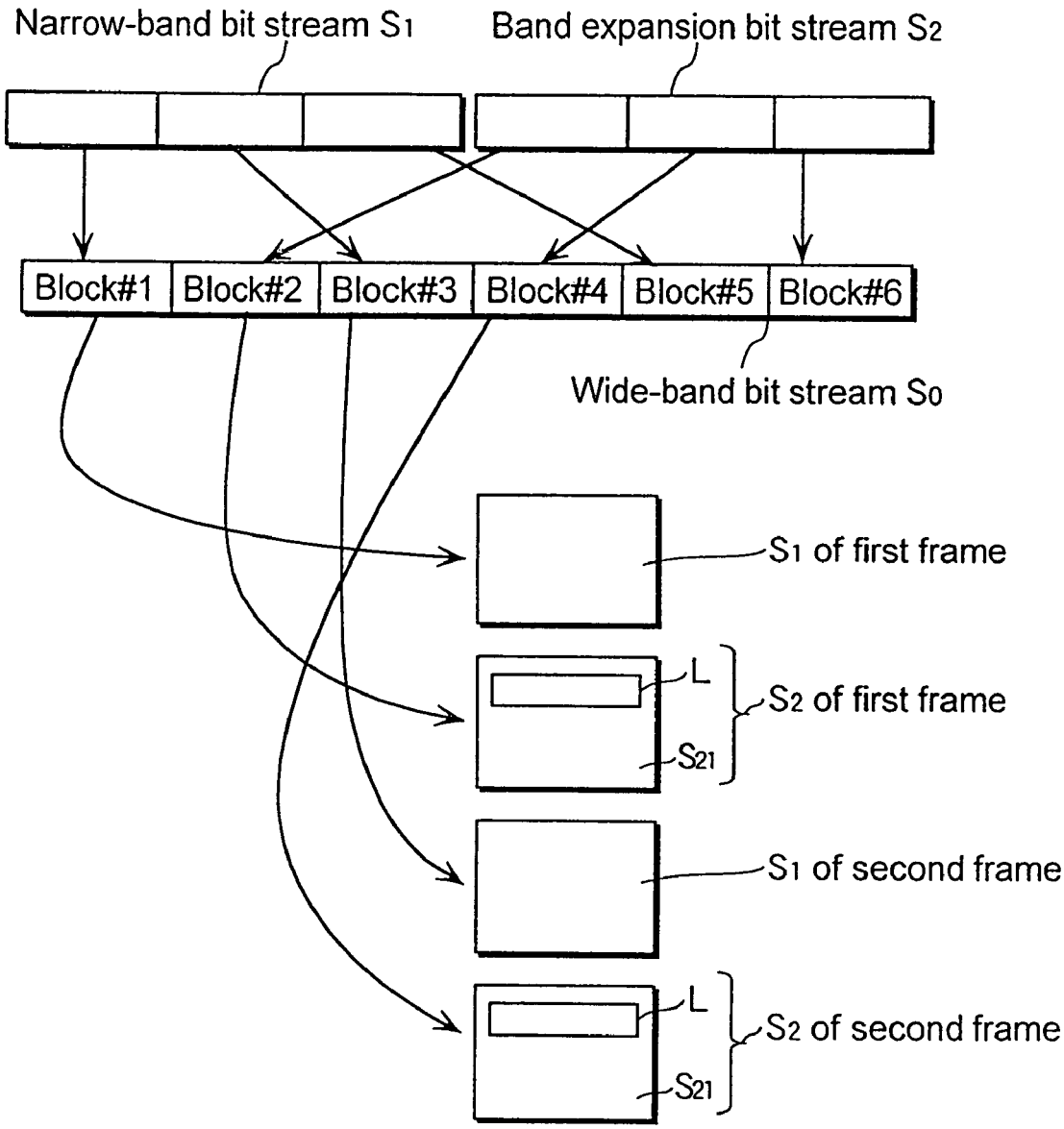
FIG. 7 is a diagram showing a format configuration of a bit stream outputted from the encoding device 10.

Consequently, an encoded signal (wide-band bit stream S0) is formed in which the narrow-band bit stream S1 and the band expansion bit stream S2 are multiplexed per frame as shown in FIG. 7, for example.

This encoded signal has a block configuration. Data of the narrow-band bit stream S1 or the band expansion bit stream S2 for each multiplexing processing is stored in each block.

Note that although data for each multiplexing processing is described in this embodiment as audio data in one frame, a specified number of frames (e.g. 2 frame, 3 frame etc.) is also acceptable.

In the next block of a block where frame data of the narrow-band bit stream is stored, the corresponding frame data of band expansion bit stream is stored. Furthermore, as shown in FIG. 7, the length information L calculated in the code amount calculating unit 13 is stored in the parts enclosed by the thin lines in the band expansion bit stream S2 (e.g. the header parts).

The length information L here is information to be used by the decoding device to judge the end of a block where data of a band expansion bit stream is stored. However, as long as the decoding device can judge the end of a block, information used for judgment can be, for example, position information indicating the end of the block whose starting point is the top of a wide-band bit stream. Moreover, information indicating the top position of the next block can substitute for this.

Note that the length information L in this embodiment is stored as part of the band expansion bit stream, but it can also exist as another stream.

Therefore, it is possible to decode the narrow-band bit stream S1 and the band expansion bit stream S2 together as well as decoding only the narrow-band bit stream S1 with only the band expansion bit stream S2 excluded.

As explained above, with the encoding device 10 according to the First Embodiment comprising the narrow-band encoding unit 11 which encodes an inputted PCM signal per frame, the band expanding encoding unit 12 which encodes band expansion information used for expanding the reproduction band of a reproduced signal per frame, the code amount calculating unit 13 which calculates the code amount per frame (length information L) outputted from the band expanding encoding unit 12, the code amount multiplexing unit 14 which multiplexes a signal to be determined according to the code amount (length information L) and an output signal of the band expanding encoding unit 12 (band expansion information S21), and the stream multiplexing unit 15 which multiplexes the narrow-band bit stream S1 outputted from the narrow-band encoding unit 11 and the band expansion bit stream S2 outputted from the code amount multiplexing unit 14 per frame, since the encoded signal includes the above-mentioned length information in the band expanding bit stream, it becomes possible in a decoding device as described later to skip the band expansion bit stream S2 after processing the narrow-band bit stream S1 per frame to start processing for the narrow-band bit stream S1 of the next frame. This results in significant reduction in the amount of decoding processing performed in the mode which is not intended for listening to wide-band signals.

The Second Embodiment

Next, an explanation is provided for a decoding device according to the Second Embodiment of the present invention with reference to the figures.

Figure 8:
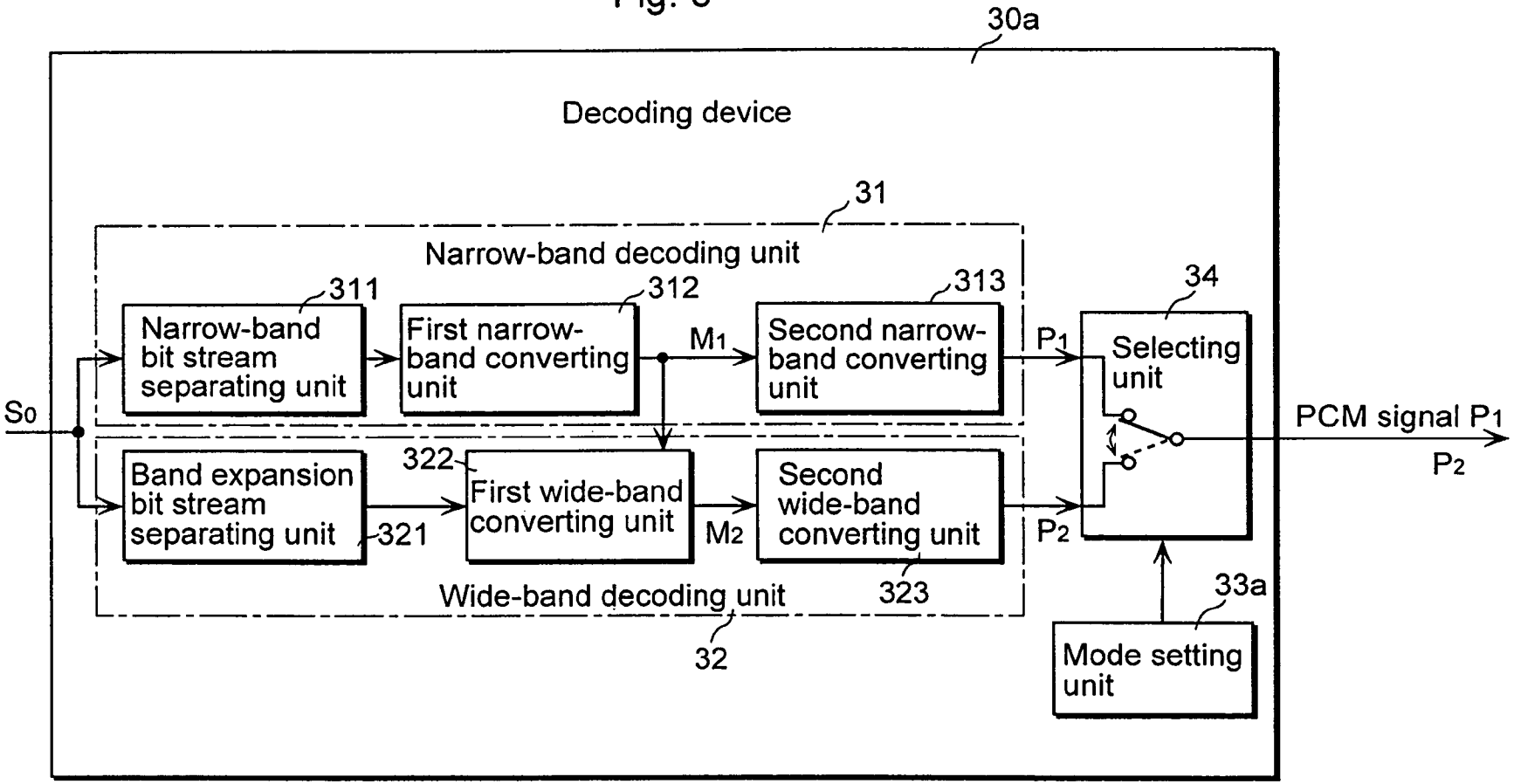
FIG. 8 is a block diagram showing a functional configuration of a decoding device according to the Second Embodiment of the present invention.

FIG. 8 is a block diagram showing a functional configuration of a decoding device 30*a* according to the Second Embodiment.

The decoding device 30*a* is comprised of a narrow-band decoding unit 31 which separates and decodes only the narrow-band bit stream S1 from the wide-band bit stream S0 outputted from the encoding device 10, a wide-band decoding unit 32 which separates and decodes only the band expansion bit stream S2, a selecting unit 34 which selects either a PCM signal in the narrow band (narrow-band PCM signal) decoded by the narrow-band decoding unit 31 or a PCM signal in the wide band (wide-band PCM signal) which is decoded by the wide-band decoding unit 32 and which expands to the narrow band by the amount of band expansion, and a mode setting unit 33*a* which sets a signal selection mode selected by the selecting unit 34.

The narrow-band decoding unit 31 is made up of a narrow-band bit stream separating unit 311, a first narrow-band converting unit 312, and a second narrow-band converting unit 313.

The wide-band decoding unit 32 comprises a band expansion bit stream separating unit 321, a first wide-band converting unit 322, and a second wide-band converting unit 323.

As illustrated in FIG. 7, an encoded signal (wide-band bit stream S0) to be inputted is the result of multiplexing per frame the narrow-band bit stream S1, which is an encoded PCM signal, and the band expansion bit stream S2, which is an encoded band expansion information for expanding the reproduction band of this narrow-band bit stream S1 to higher frequencies.

The narrow-band bit stream separating unit 311 of the narrow-band decoding unit 31 separates only the narrow-band bit stream S1 from the inputted encoded signal (wide-band bit stream S0).

The first narrow-band converting unit 312 converts the narrow-band bit stream S1 to an intermediate signal M1.

The second narrow-band converting unit 313 converts the intermediate signal M1 to a PCM signal 1.

The band expansion bit stream separating unit 321 of the wide-band decoding unit 32 separates only the band expansion bit stream S2 from the inputted encoded signal (wide-band bit stream S0).

The first wide-band converting unit 322 uses an output of the band expansion bit stream separating unit 321 and the intermediate signal M1 outputted from the first narrow-band converting unit 312 to convert them to an intermediate signal M2.

The second wide-band converting unit 323 converts the intermediate signal M2 to a PCM signal 2.

The mode setting unit 33*a* can set at least two values of ON/OFF.

The selecting unit 34 outputs a PCM signal 1 when the mode is set to ON and outputs a PCM signal 2 when the mode is set to OFF.

Note that, as in the case of the encoding device 10, each unit making up such a decoding device as the decoding device 30*a* is realized by a CPU, ROM to store a program executed by the CPU, a memory which provides a work area when the program is executed and which temporarily memorizes data of an inputted encoded signal and others.

The operation of the decoding device 30*a* having the above configuration is explained below.

First, the narrow-band bit stream separating unit 311 of the narrow-band decoding unit 31 acquires an inputted encoded signal (wide-band bit stream S0) to separate only the narrow-band bit stream S1 from it. The narrow-band bit stream S1 here is something like a bit stream in the MPEG MC system. In this case, a commonly known technology can be used as a means to separate the bit stream from the inputted encoded signal, in which a grammatical rule specified in the MPEG MC system is observed (ISO/IEC 13818-7: 1997).

Next, the band expansion bit stream separating unit 321 of the wide-band decoding unit 32 acquires the wide-band bit stream S0, which is an inputted encoded signal, and separates only the band expansion bit stream S2 from it. At this stage, information for expanding the reproduction band used when reproducing the narrow-band bit stream S1 (band expansion information 21) is included in the band expansion bit stream S2. The band expansion information S21, for example, is information used to control such processing as moving a part of a frequency spectrum generated from the narrow-band bit stream S1 to the higher frequency band according to specific rules.

Figure 9:
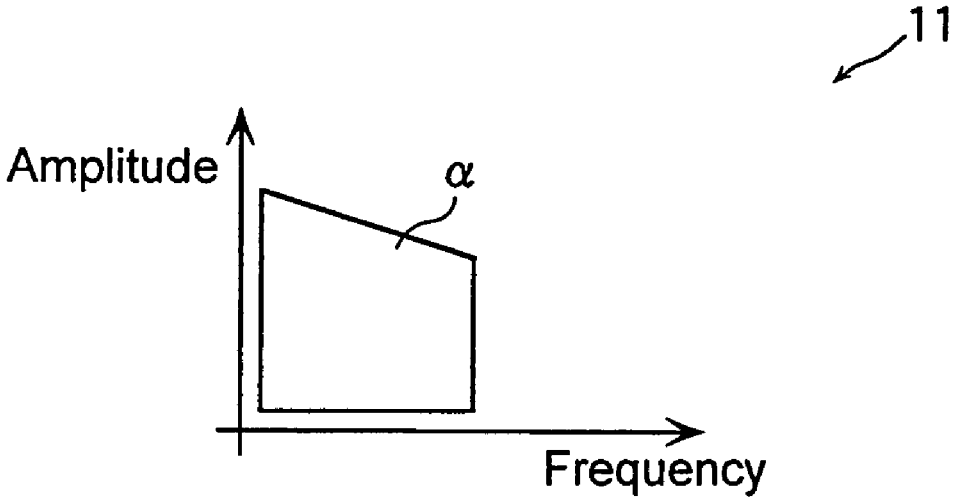
FIG. 9 is a diagram showing a frequency band when reproducing a narrow-band sound.

Then, the first narrow-band converting unit 312 converts the narrow-band bit stream S1 to an intermediate signal M1. The intermediate signal here can be, for example, a frequency spectrum signal, which is the previous form of a PCM signal to be reproduced. An example is provided in FIG. 9, in which the part enclosed in the solid lines a represents the frequency band of a frequency spectrum signal generated in the first narrow-band converting unit 312. Or, this intermediate signal M1 can be a time domain signal, which is the previous form of a PCM signal to be reproduced. For example, if a PCM signal to be reproduced is a signal to be represented by 16-bit integer, this intermediate signal M1 can be a signal to be represented by 32-bit floating point or a signal to be represented by 32-bit integer.

Next, the first wide-band converting unit 322 performs band expanding processing for the frequency spectrum signal using an output of the band expansion bit stream separating unit 321, that is, information used for expanding the reproduction band so as to generate an intermediate signal M2. An example is provided in FIG. 10, in which the part enclosed in the dotted lines β represents the frequency band of the frequency spectrum signal complemented by the first wide-band converting unit 322. At this stage, such processing as moving a part of the frequency spectrum generated from the narrow-band bit stream to the higher frequency band according to specific rules is performed. The intermediate signal M2 here can be a frequency spectrum signal, which is the previous form of a PCM signal to be reproduced, or a time domain signal, which is the previous form of a PCM signal to be reproduced. For example, if a PCM signal to be reproduced is a signal to be represented by 16-bit integer, this intermediate signal M2 can be a signal to be represented by 32-bit floating point or a signal to be represented by 32-bit integer.

Then, when this intermediate signal M1 is a frequency spectrum signal, the second narrow-band converting unit 313 converts this frequency spectrum signal to a time domain signal in the narrow band by means of inverse MDCT processing, for example. If the intermediate signal M2 is a time domain signal, which is the previous form of a PCM signal to be reproduced, that is, if the intermediate signal M2 is a signal to be represented by 32-bit floating point, for example, the floating point signal is converted to a signal to be represented by 16-bit integer, which is a PCM signal to be reproduced.

Figure 10:
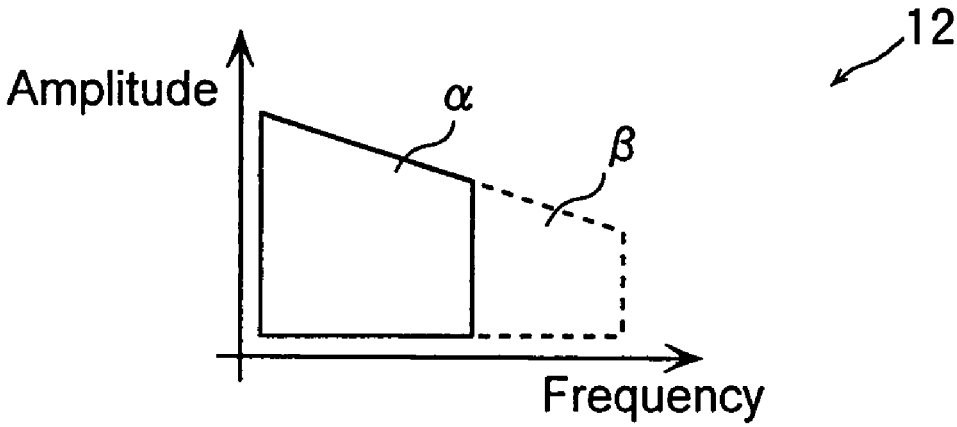
FIG. 10 is a diagram showing a frequency band when reproducing a wide-band sound.

Then, the second wide-band converting unit 323 converts the intermediate signal M2, that is, the frequency spectrum signal illustrated in FIG. 10 to a wide-band PCM signal. When this is done, such a means as converting a frequency spectrum signal to a time domain signal just like inverse MDCT processing is performed.

Finally, with at least two values of ON/OFF being able to be set in the mode setting unit 33*a*, the selecting unit 34 outputs the narrow-band PCM signal, which is an output of the second narrow-band converting unit 313, when the mode is set to ON, and outputs the wide-band PCM signal, which is an output of the second wide-band converting unit 323, when the mode is set to OFF.

As explained above, with the decoding device 30*a* according to the Second Embodiment comprising the narrow-band bit stream separating unit 311 which separates the narrow-band bit stream S1 from an encoded signal (wide-band bit stream S0), the band expansion bit stream separating unit 321 which separates the band expansion bit stream S2 from the encoded signal, the first narrow-band converting unit 312 which converts the narrow-band bit stream S1 to an intermediate signal M1, the first wide-band converting unit 322 which uses an output of the band expansion bit stream separating unit 321 (band expansion information S21) and the intermediate signal M1 to convert them to an intermediate signal M2, the second narrow-band converting unit 313 which converts the intermediate signal M1 to a narrow-band PCM signal P1 in the narrow band, the second wide-band converting unit 323 which converts the intermediate signal M2 to a wide-band PCM signal P2, the mode setting unit 33 which can set at least two values of ON/OFF, and the selecting unit 34 which outputs a narrow-band PCM signal P1 when the mode is set to ON and outputs a wide-band PCM signal P2 when the mode is set to OFF, it becomes possible to make an easy switching between the output PCM signal P2 for which band expansion is performed and the output PCM signal P1 for which band expansion is not performed.

The Third Embodiment

Next, an explanation is provided for a decoding device 30*b* according to the Third Embodiment of the present invention.

Figure 11:
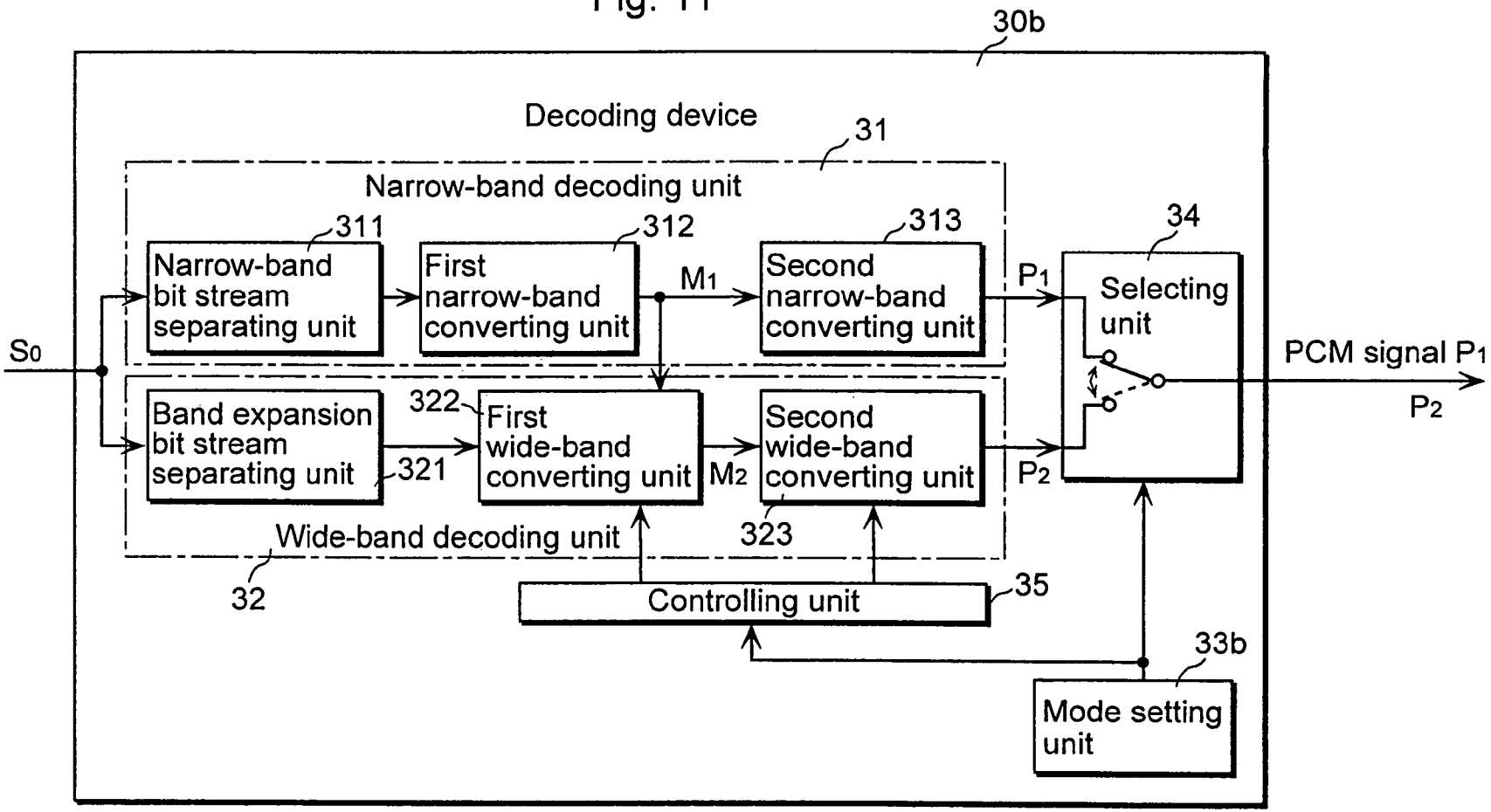
FIG. 11 is a block diagram showing a functional configuration of the decoding device according to the Third Embodiment.

FIG. 11 is a block diagram showing a functional configuration of a decoding device 30 according to the decoding device 30*b* of the present invention. Note that the same numbers as those used for the decoding device 30*a* in FIG. 8 are assigned to the corresponding parts in FIG. 11, in which detailed explanations are given only for the parts different from FIG. 8.

It should be noted that, in the decoding device 30*a* according to the Second Embodiment, the selecting unit 34 is responsible for the selection between a PCM signal P2 for which band expansion is performed and an output PCM signal P1 for which band expansion is not performed, but the decoding device 30*b* further includes a controlling unit 35 so as to reduce the processing amount at the time of outputting a PCM signal P1 for which band expansion is not performed.

The controlling unit 35 is intended to stop at least partly the operation of at least either the first wide-band converting unit 322 or the second wide-band converting unit 323 when the mode set by the mode setting unit 33 is OFF. For example, processing to be performed by the second wide-band converting unit 323 can be stopped by the controlling unit 35.

As mentioned above, this processing, for example, is to convert a frequency spectrum signal for which band expansion is performed to a PCM signal P2, and more specifically, such processing as inverse MDCT processing is actually performed, in which a frequency spectrum signal is converted to a time domain signal. As a result, this processing accompanies a substantial amount of processing. Therefore, since there is no need for outputting the PCM signal P2 for which band expansion is performed when the mode is set to OFF, it is possible to stop such processing, which leads to reduction in the processing amount as well as in power consumption.

Meanwhile, since the processing to be performed by the first wide-band converting unit 322 is also unnecessary, it is desirable to stop this processing as well. If the processing by the first wide-band converting unit 322 is also stopped, it allows a further reduction in power consumption.

The Fourth Embodiment

Next, an explanation is provided for a decoding device 30*c* according to the Fourth Embodiment of the present invention.

Figure 12:
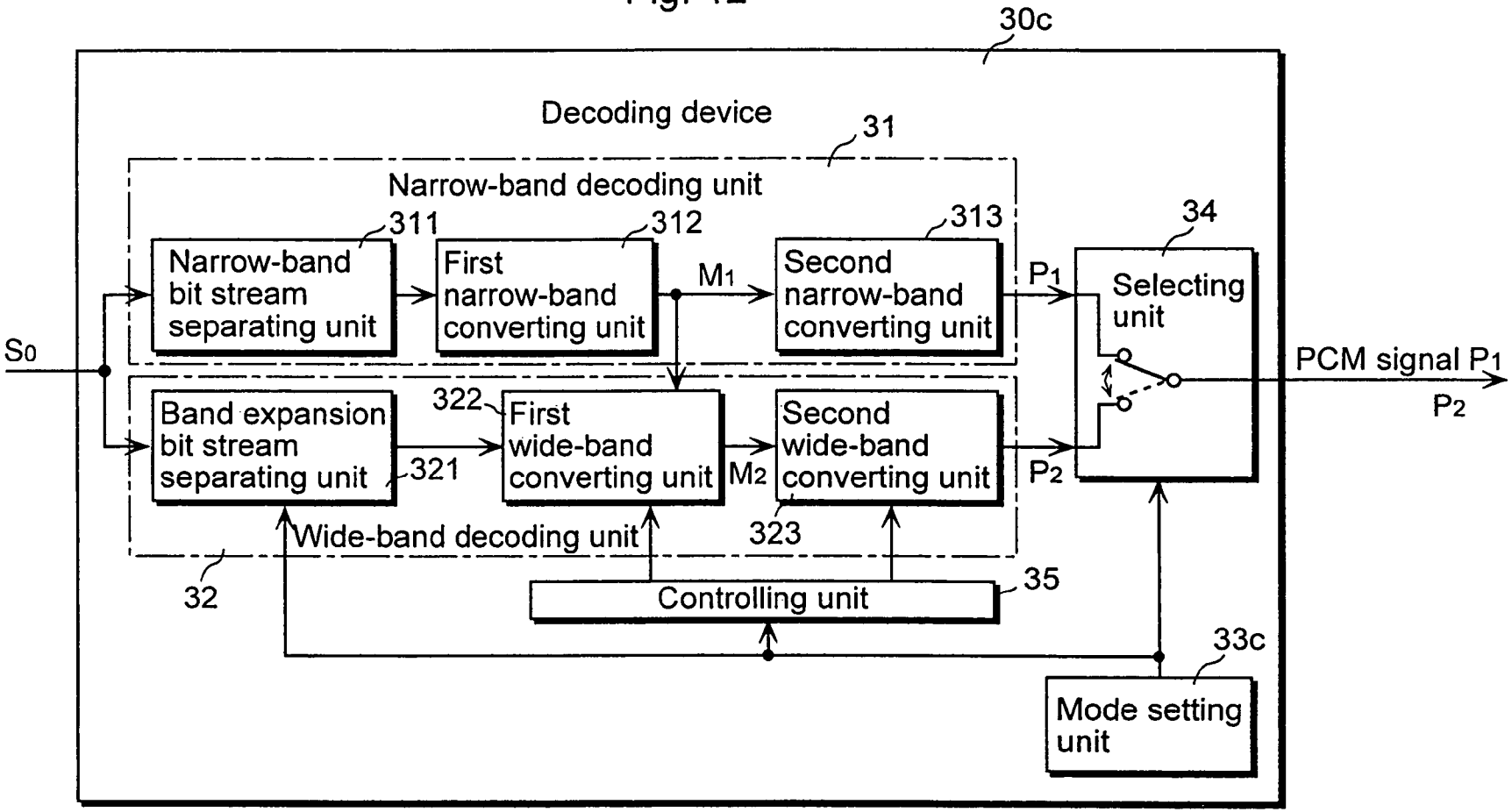
FIG. 12 is a block diagram showing a functional configuration of the decoding device according to the Forth Embodiment.

FIG. 12 is a block diagram showing a functional configuration of the decoding device 30*c* according to the Third Embodiment of the present invention. Note that the same numbers as those used for the decoding device 30*b* in FIG. 11 are assigned to the corresponding parts in FIG. 12, in which detailed explanations are given only for the parts different from FIG. 11.

It should be noted that, in the decoding device 30*b* according to the Third Embodiment, the controlling unit 35 is intended to stop at least partly the operation of at least either the first wide-band converting unit 322 or the second wide-band converting unit 323 when the mode set by the mode setting unit 33 is OFF, but the decoding device 30*c* according to the Fourth Embodiment of the present invention is capable of further reducing the processing amount when outputting an output PCM signal P1 for which band expansion is not performed.

In other words, the decoding device 30*c* is further intended to allow an output of the mode setting unit 33*c* to be inputted to the band expansion bit stream separating unit 321.

The band expansion bit stream separating unit 321 of the decoding device 30*c* separates the band expansion bit stream S2 from an inputted encoded signal based on the information L indicating the length of the band expansion bit stream S2 when the mode is set to OFF by the mode setting unit 33*c*. That is to say, since the information L indicating the length of the band expansion information S21 is multiplexed into the band expansion bit stream S2, the reading of the band expansion information S21 included in the band expansion bit stream S2 can be skipped according to this length information L.

Figure 13:
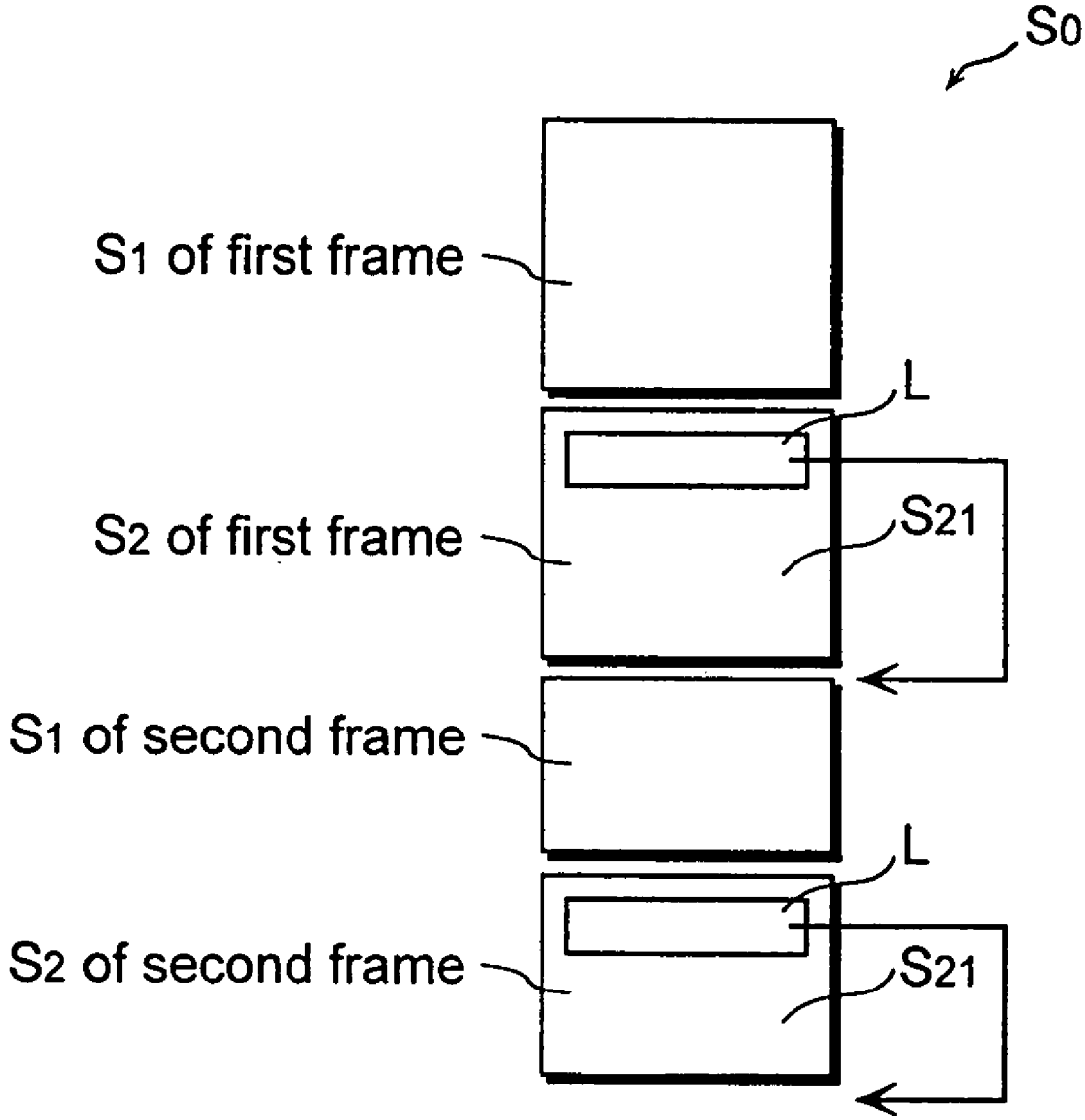
FIG. 13 is a diagram showing how processing for separating band expansion information is skipped based on length information, when reproducing a narrow-band sound.
Figure 14:
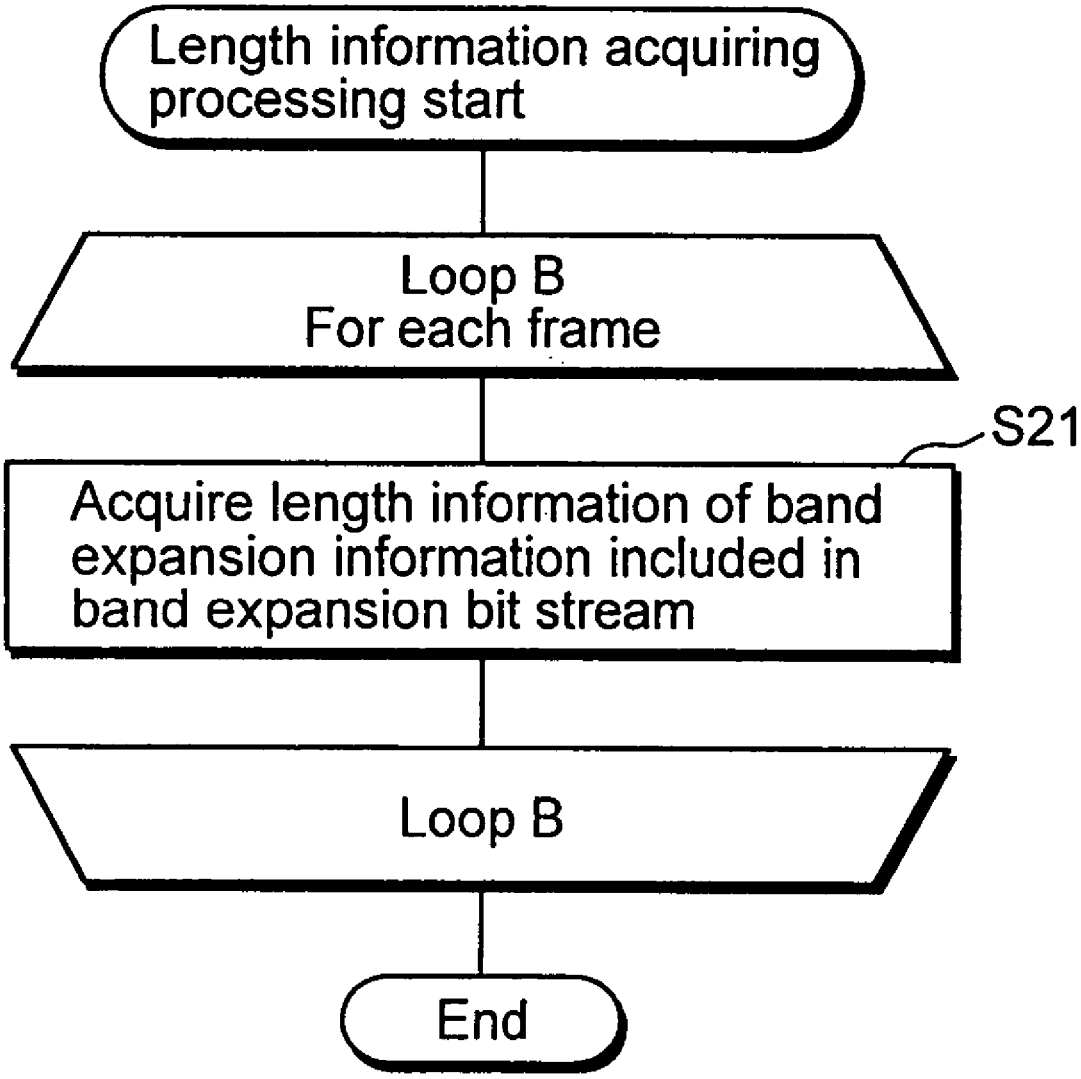
FIG. 14 is a flowchart showing length information acquiring processing.

Therefore, as shown in FIG. 13, the decoding device 30*c* is capable of skipping the reading and decoding of the band expansion bit stream S2 (band expansion information S21) after decoding the narrow-band bit stream S1 per frame and starting the processing of the narrow-band bit stream S1 of the next frame, which allows a significant reduction in the processing amount.

Figure 15:
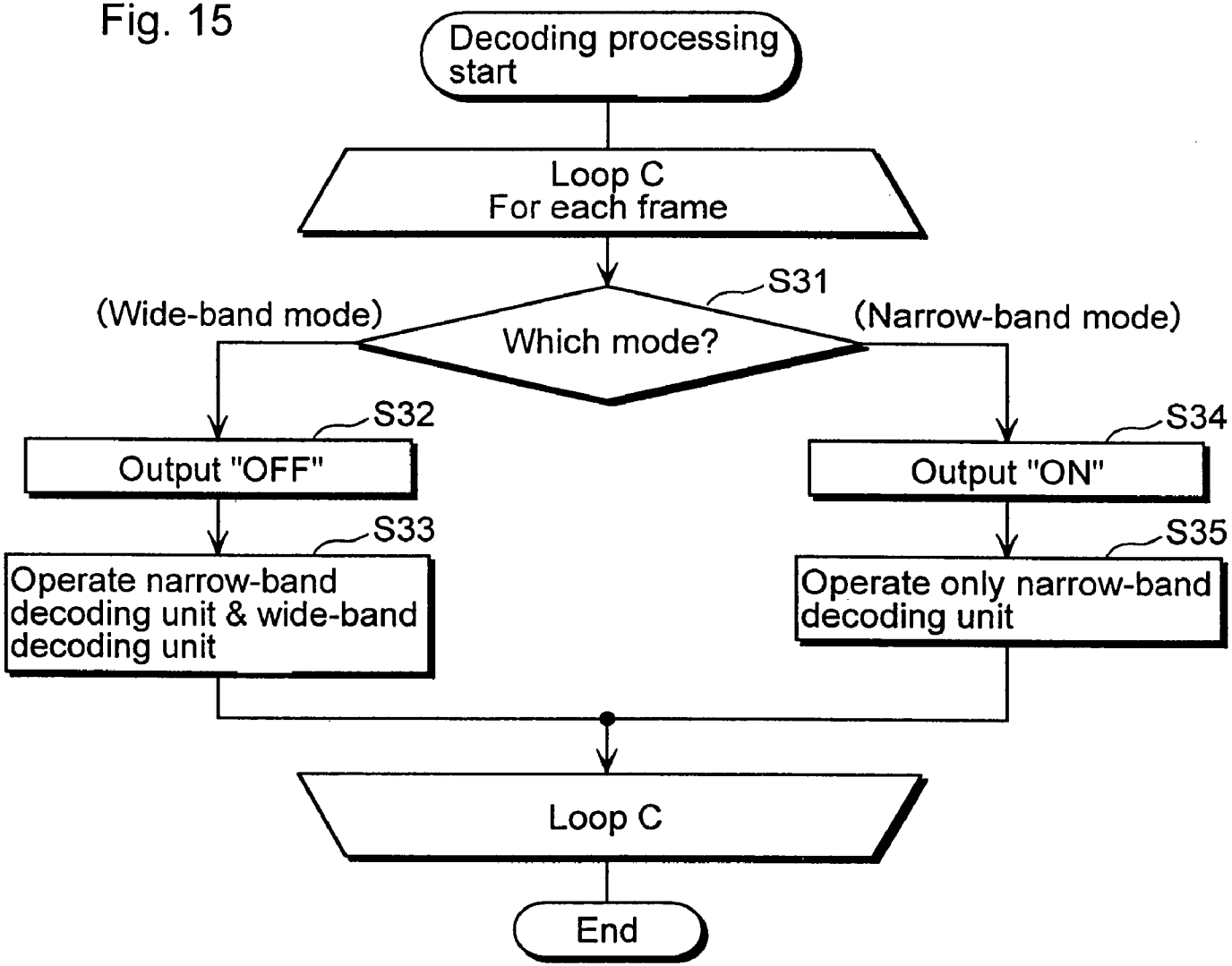
FIG. 15 is a flowchart showing details of decoding processing.

To be more specific, as shown in FIG. 15, the mode setting unit 33*c* in the decoding device 30*c* has the band expansion bit stream separating unit 321 execute processing for acquiring the length information L of the band expansion information S21 included in the band expansion bit stream S2 per frame (S21).

Then, the mode setting unit 33*c* judges whether the mode is either the wide-band mode or the compatibility mode on a per-frame basis (S31). If the mode is judged to be the wide-band mode, the mode setting unit 33*c* outputs "OFF" (S32), operates the narrow-band decoding unit 31 and the wide-band decoding unit 32 (S33) to output a wide-band PCM signal using the band expansion information S21. On the other hand, when the mode is the narrow-band mode, the mode setting unit 33*c* outputs "ON" (S34) to skip the acquisition of the band expansion information S21 and processing of the first wide-band converting unit 322 and the second wide-band converting unit 323, operates only the narrow-band decoding unit 31 (S35) to output a narrow-band PCM signal.

Figure 16:
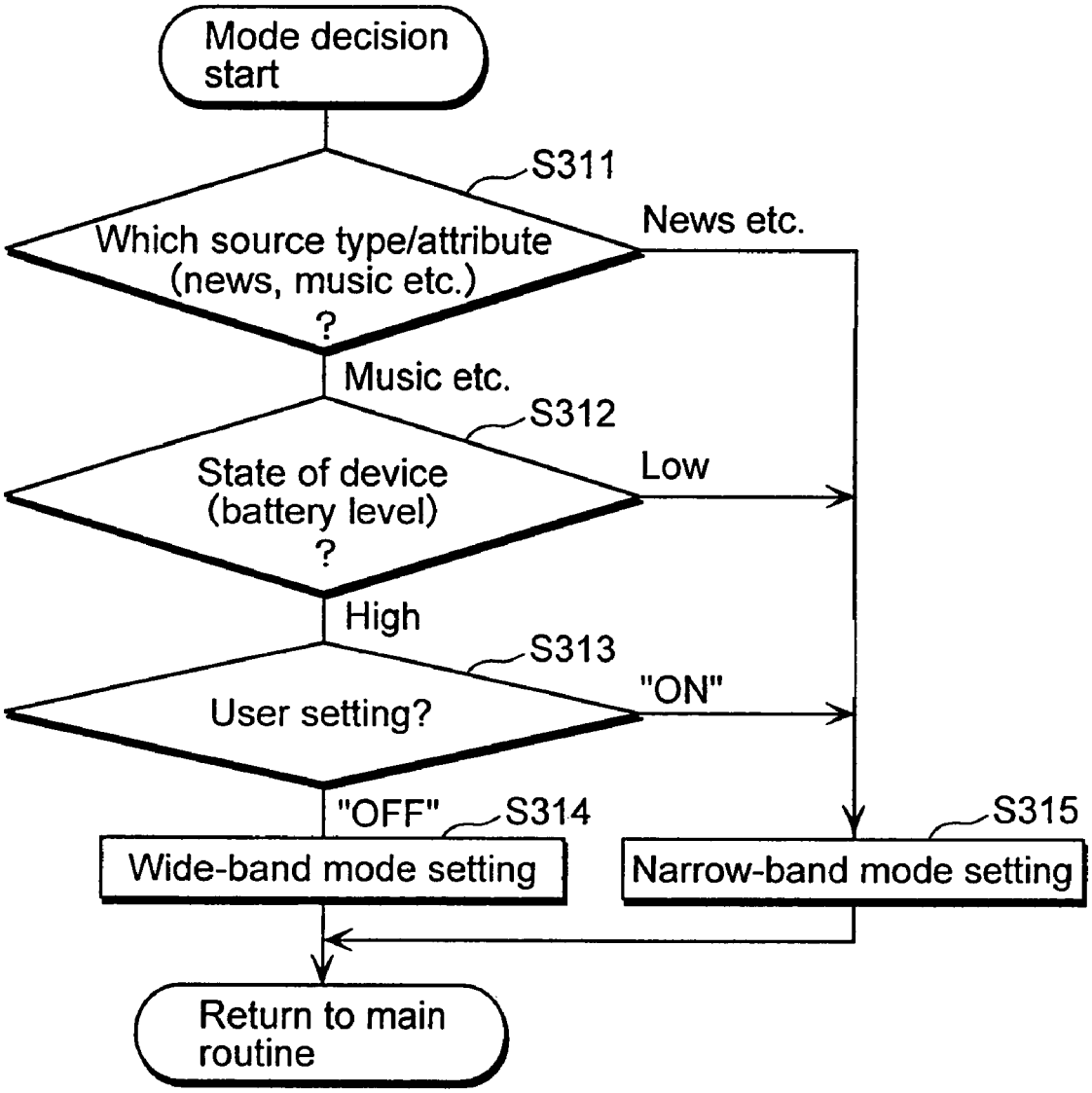
FIG. 16 is a flowchart showing details of mode decision processing.

Note that the decision processing at Step S31 is performed by a subroutine as shown in FIG. 16.

In this mode decision subroutine, the mode setting unit 33*c* first determines whether to set to the wide-band mode or the narrow-band mode depending on where the type and attribute of a source to be reproduced belongs, i.e. news, music or others (S311). If the source belongs to music or the like which requires the reproduction of high frequencies, the mode setting unit 33*c* further determines whether to set the mode to the wide-band mode or the narrow-band mode depending on the state of a device (e.g. whether the battery energy level of a mobile phone is high or low) (S312). If the battery energy level is high, the mode setting unit 33*c* further judges if the user setting for the selecting unit 34 is "OFF" or not (S313). Only when the setting is "OFF," that is, when all three conditions (S311-S313) are fulfilled, the mode setting unit 33*c* sets the mode to the wide-band mode (S314) and returns to the main routine. On the other hand, when any one of the three conditions is not satisfied, the mode is set to the narrow-band mode (S315) and returns to the main routine.

It therefore becomes possible to make a significant reduction in the amount of unnecessarily performed processing, resulting in reduced battery consumption as well as longer battery usage.

Note that although the encoding device 10 and the decoding device 30*a*~30*c* according to the above embodiments are realized by using a program and others, it is also acceptable that they are configured by hardware realized as an LSI in which each unit is realized by a logic circuit and others.

Furthermore, although information of the narrow-band bit stream S1 is complemented by the band expansion information S21 in the frequency band, this can be also carried out on the time domain.

Moreover, although the above embodiments provide explanations for the case where the application is made to MC, it goes without saying that a system comprised of an encoding device and a decoding device in the MP3 Professional system or the like is also in the range of application.

The following is an application example of the encoding device and the decoding device described from the First Embodiment to the Fourth Embodiment as well as an explanation of a system utilizing them.

Figure 17:
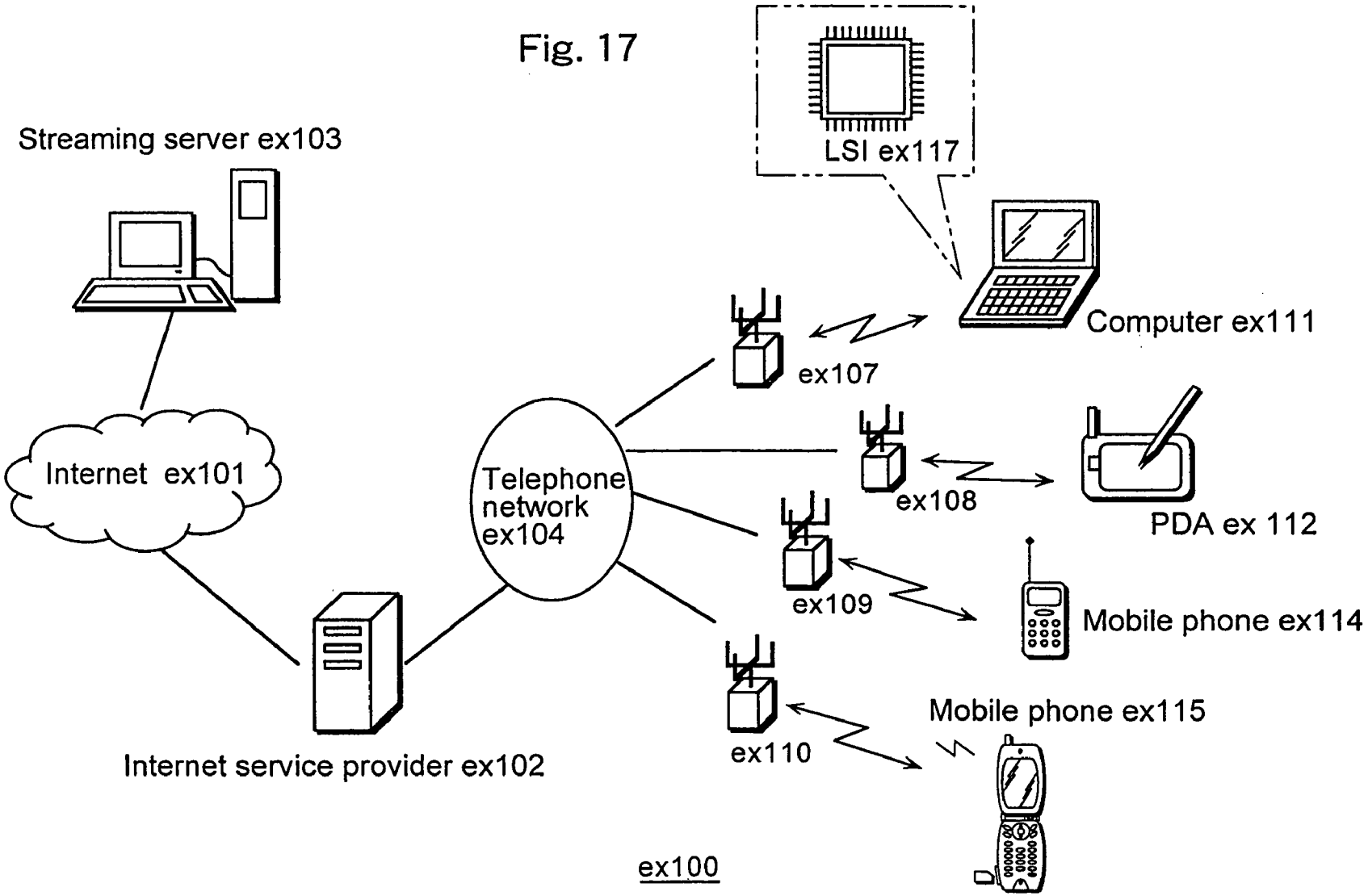
FIG. 17 is a block diagram showing an entire configuration of a content supply system.

FIG. 17 is a block diagram showing the entire configuration of a content supply system ex100 which realizes a content distribution service.

This content supply system ex100, for example, is comprised of a streaming server ex103, an Internet service provider ex102, each device such as a computer ex111, a PDA (Personal Digital Assistant) ex112, a mobile phone ex114, a camera-equipped mobile phone ex115 and others, the Internet ex101 which connects the streaming server ex103 and the internet service provider ex102, a telephone network ex104 which connects the internet service provider ex102 and each device (ex111, ex112, ex114, and ex115) and base stations ex107~ex110, and so forth.

Note that the content supply system ex100 is not restricted to the above combination of elements, some of which, therefore, can be combined to realize a connection. It is also acceptable that each device is directly connected to the telephone network ex104 not via fixed wireless stations, that is, the base stations ex107~ex110.

The streaming server ex103, which includes an encoding device explained in the First Embodiment, is a server responsible for carrying out stream distribution of sources such as news to be transmitted via the internet service provider ex102 and a pre-accumulated sources such as music after encoding these sources by the encoding device, for the devices ex111, ex112, ex114, and ex115 which made a distribution request.

Each device ex111, ex112, ex114, and ex115 making up this system has an LSI ex117 in which an encoding device and a decoding device explained in the Second Embodiment, the Third Embodiment and the Fourth Embodiment are realized as hardware, decodes a source transmitted by means of stream distribution in the decoding device and reproduces it. The mobile phones ex114 and ex115 here can be any one of the following: a mobile phone in PDC (Personal Digital Communications) system, CDMA (Code Division Multiple Access) system, W-CDMA (Wideband-Code Division Multiple Access) system or in GSM (Global System for Mobile Communications), or a PHS (Personal Handyphone System) and for forth. Here, a mobile phone is taken up as an example of such device, an explanation for which is given below.

Figure 18:
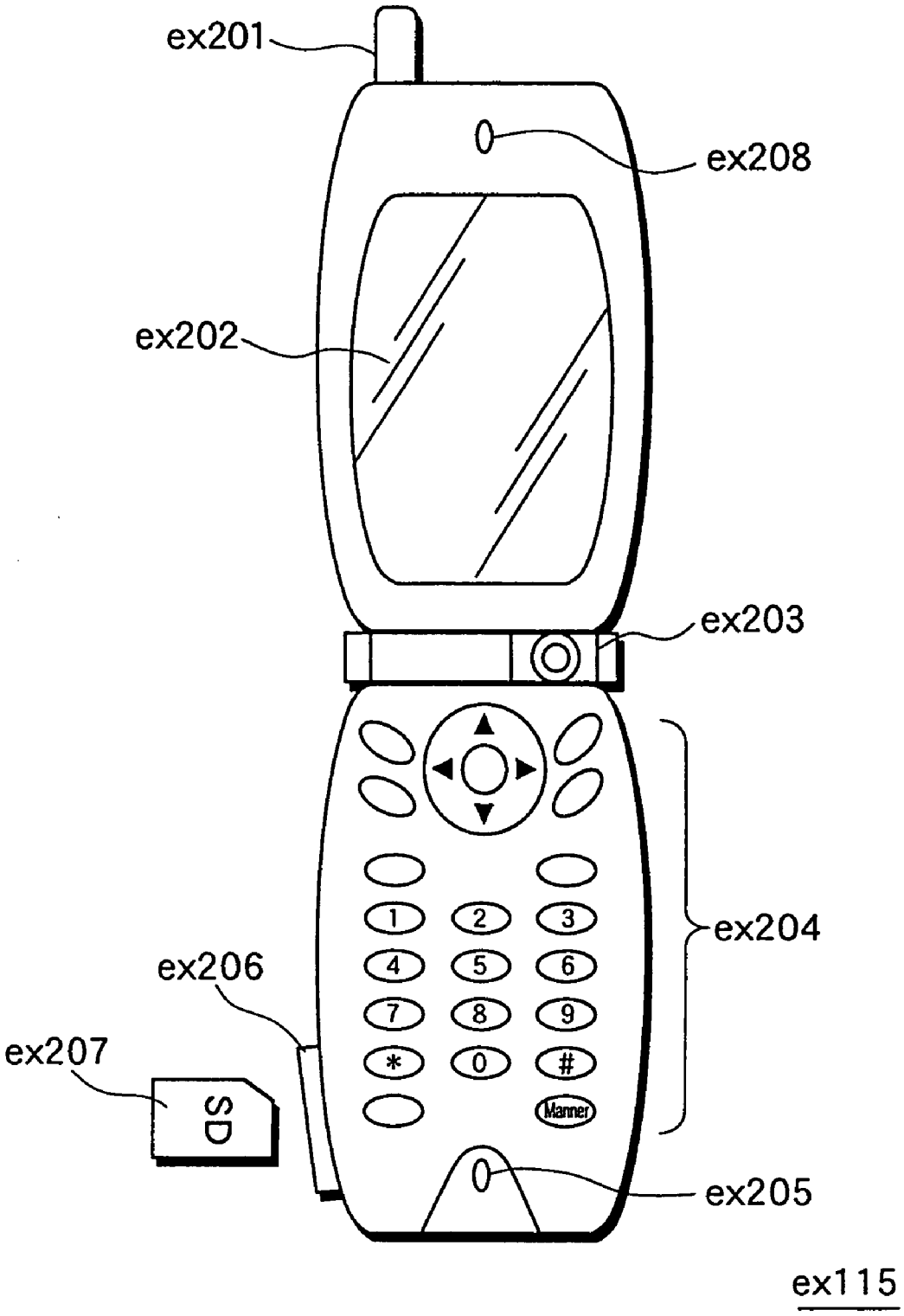
FIG. 18 is a diagram showing an exterior configuration of a mobile phone.

FIG. 18 is a diagram showing an exterior configuration of the mobile phone ex115 in which an encoding device and a decoding device explained in the above embodiment are used.

The mobile phone ex115 comprises an antenna ex201 for transmitting and receiving radio waves between the base station ex110, a camera unit ex203 such as a CCD camera capable of taking a picture and a still image, a display unit ex202 such as a liquid crystal display for displaying a picture taken by the camera unit ex203 and a picture and others received by the antenna ex201 in the form of decoded data, a main body comprised of a set of operation keys ex204, a voice output unit ex208 such as a speaker to output voice, a voice input unit ex205 such as a microphone for inputting voice, a storage medium ex207 for storing encoded or decoded data such as data of moving image/still image which were taken, received mail data, moving image data and still image data, and a slot unit ex206 for attaching the storage medium ex207 to the mobile phone ex115. The storage medium ex207 is a medium to store a flash memory device, which is a kind of nonvolatile memory EEPROM (Electrically Erasable and Programmable Read Only Memory) in a plastic case such as an SD card.

Figure 19:
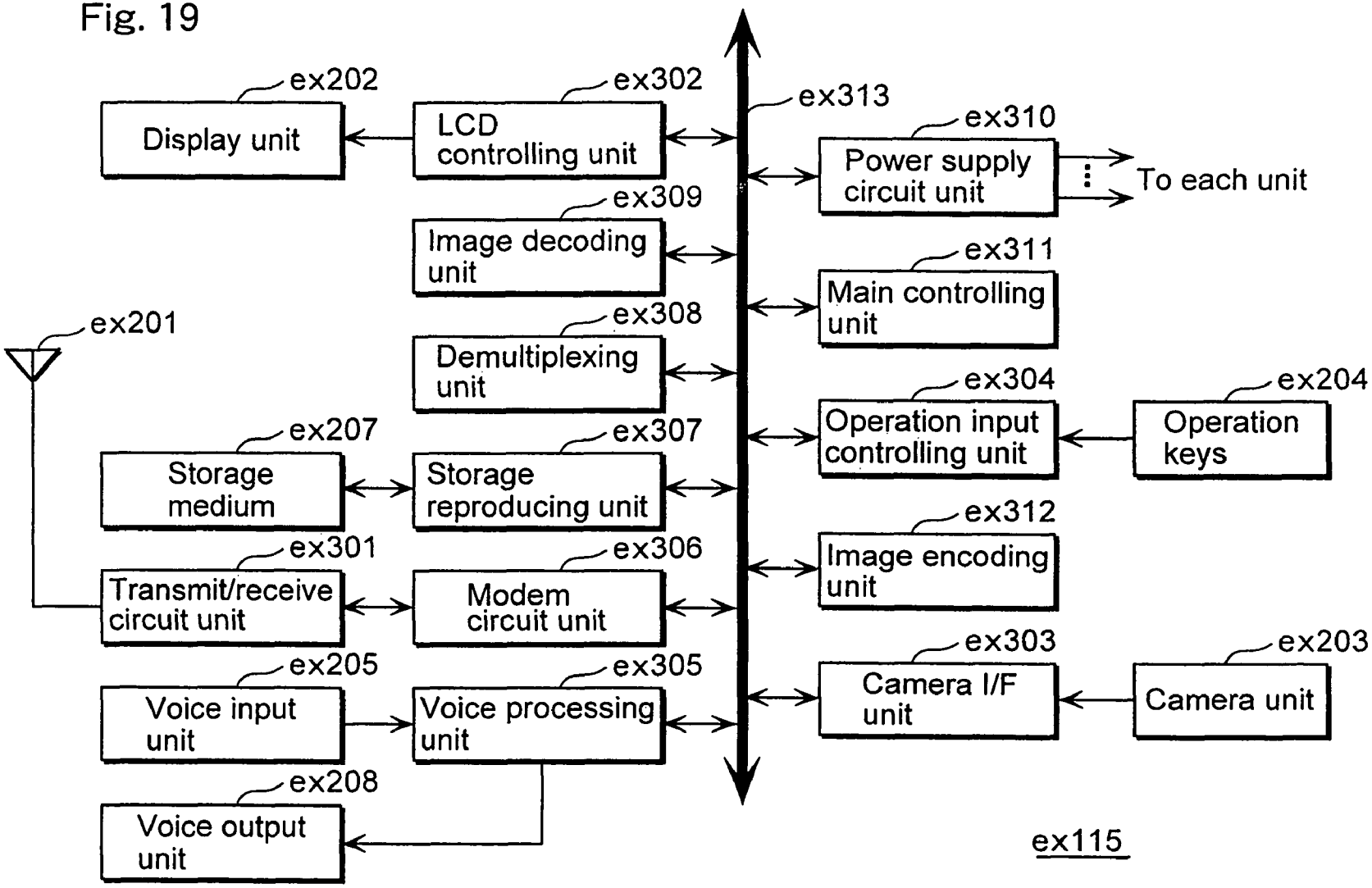
FIG. 19 is a block diagram showing a circuit configuration of a mobile phone.

A further explanation of the mobile phone ex115 is provided with reference to FIG. 19.

The mobile phone ex115 is configured in a manner in which a power supply circuit unit ex310, an operation input controlling unit ex304, a image encoding unit ex312, a camera interface unit ex303, an LCD (Liquid Crystal Display) controlling unit ex302, an image decoding unit ex309, a demultiplexing unit ex308, a storage reproducing unit ex307, a modem circuit unit ex306, and an voice processing unit ex305 are interconnected via a synchronous bus ex313, facing a main controlling unit ex311 which is intended to control each unit of the main body having the display unit ex202 and the operation keys ex204 in an integrated manner.

When the call-ending key and the power key are set to ON by the user, the power supply circuit unit ex310 activates the camera-equipped digital mobile phone ex115 to have it ready for operations by supplying power for each unit from the battery pack.

Under the control of the main controlling unit ex311 comprised of a CUP, ROM, RAM and others, the mobile phone ex115 converts a voice signal collected by the voice input unit ex205 when in the voice-calling mode to digital voice data in the voice processing unit ex305 having an encoding device and a decoding device explained in the present invention, performs spread spectrum processing for this digital voice data in the modem circuit unit ex306, and after performing digital-analogue converting processing and frequency converting processing in the transmit/receive circuit unit ex301, transmits this digital voice data via the antenna ex201. Furthermore, the mobile phone ex115 amplifies a received signal received by the antenna ex201 while in the voice-calling mode or in the content receiving mode to perform frequency converting processing and analogue-digital converting processing, performs inverse spread spectrum processing in the modem circuit unit ex306 and after converting the signal into an analogue voice signal in the voice processing unit ex305, outputs the signal via the voice output unit ex208.

Furthermore, when sending E-mail while in the data communication mode, text data of the E-mail inputted through the operation keys ex204 on the main body is exported to the main controlling unit ex311 via the operation input controlling unit ex304. Then, the main controlling unit ex311 performs spread spectrum processing for the text data in the modem circuit unit ex306 and transmits it to the base station ex110 via the antenna ex201 after performing digital-analogue converting processing and frequency converting processing in the transmit/receive circuit unit ex301.

When sending image data while in the data communication mode, image data taken by the camera unit ex203 is provided to the image encoding unit ex312 via the camera interface unit ex303. When image data is not to be sent, it is possible to directly display the image data taken by the camera unit ex203 on the display unit ex202 via the camera interface unit ex303 and the LCD controlling unit ex302.

By performing a compression encoding for image data provided from the camera unit ex203 using the encoding method used for the image encoding device described in the above embodiments, the image encoding unit ex312 converts the image data to encoded image data to send it to the demultiplexing unit ex308. When this is done, the mobile phone ex115 sends voice collected through the voice input unit ex205 while the image is being taken by the camera unit ex203 to the demultiplexing unit ex308 as digital voice data via the voice processing unit ex305.

The demultiplexing unit ex308 multiplexes the encoded image data provided from the image encoding unit ex312 and the voice data provided from the voice processing unit ex305 using a specified scheme and performs spread spectrum processing for the resulting multiplexed data in the modem circuit unit ex306 and transmits this via the antenna ex201 after performing digital-analogue converting processing and frequency converting processing in the transmit/receive circuit unit ex301.

When receiving moving image file data linked on a Web page and the like while in the data communication mode, inverse spread spectrum processing is performed by the modem circuit unit ex306 for a received signal received from the base station ex110 via the antenna ex201 to send the resulting multiplexed data to the demultiplexing unit ex308.

In order to decode multiplexed data received via the antenna ex201, the demultiplexing unit ex308 separates this multiplexed data into an encoding bit stream of the image data and a decoding bit stream of the voice data, and provides the encoded image data to the image decoding unit ex309 while providing the voice data to the voice processing unit ex305 via the synchronous bus ex313 at the same time.

Next, the image decoding unit ex309 generates moving image data for playback by decoding the encoding bit stream of the image data and provides it to the display unit ex202 via the LCD controlling unit ex302, as a result of which the moving image data included in a moving image file linked to a Web page, for example, can be displayed. When this is done, the voice processing unit ex305 converts the voice data to an analogue voice signal and then provides this to the voice output unit ex208, as a result of which the voice data included in a moving image file linked to a Web page, for example, can be reproduced.

Note that the above-mentioned system is not an exclusive example, which means that at least either an encoding device or a decoding device in the above embodiments can be incorporated into a satellite/terrestrial digital broadcasting system.

Furthermore, it is possible to encode a voice signal in an encoding device according to the above embodiments and to store it in a storage medium, examples of which are a DVD recorder to store a voice signal on a DVD disk and other recorders such as a disk recorder to store a voice signal on a hard disk. Moreover, an SD card can be also used for storage. If a recorder is equipped with an encoding device as shown in the above embodiments, it is possible to reproduce and listen to voice stored on a DVD disk or in an SD card.

Concerning terminals such as the mobile phone ex114, a transmitting terminal only with an encoder and a receiving terminal only with a decoder can be also assumed as forms of implementation in addition to a transmitting/receiving terminal having both an encoder and a decoder.

As stated above, it is possible to incorporate an encoding device or a decoding device shown in the above embodiments into one of the above-mentioned devices/systems. As a result, effects explained in the above embodiments can be obtained.

INDUSTRIAL APPLICABILITY

An encoding device and a decoding device according to the present invention is suitable for use as a communication system for stream distribution of sources (content) such as music and news.

The invention claimed is:

1. A decoding method for decoding an encoded signal made up of a first bit stream which is an encoded sound digital signal (narrow band signal) and of a second bit stream which includes encoded band expansion information used for expanding a reproduction band of the sound digital signal, the decoding method comprising:

a separating step of separating the first bit stream and the second bit stream from the encoded signal; and a first reproducing step of reproducing a first sound digital signal (narrow band signal) from the separated first bit stream, wherein the encoded band expansion information and size information are multiplexed into the second bit stream, wherein the encoded band expansion information is a first bit sequence, wherein the size information indicates a length of the band expansion information, and is a second bit sequence independent of the first bit sequence, wherein the second bit sequence is located at a top of the second bit stream, wherein, in the separating step, the length of the band expansion information is acquired using the second bit sequence included at the top of the second bit stream, and wherein, when reproducing the narrow band signal, (i) the first bit stream of each frame is decoded and (ii) the second bit stream of each frame is skipped according to the length of the band expansion information.

2. The decoding method of claim 1, further comprising a second reproducing step of reproducing a second sound digital signal having a frequency band which is wider than that of the first sound digital signal reproduced at the first reproducing step from the separated first bit stream and the second bit stream.

3. The decoding method of claim 2, further comprising a mode specifying step of specifying either a first mode or a second mode according to a state of an apparatus having a decoding device, wherein, in the first reproducing step, the first sound digital signal is reproduced when the first mode is specified in the mode specifying step, and wherein, in the second reproducing step, the second sound digital signal is reproduced when the second mode is specified in the mode specifying step.

* * * * *